US008605107B2

(12) United States Patent
Choi et al.

(10) Patent No.: US 8,605,107 B2
(45) Date of Patent: Dec. 10, 2013

(54) IMAGE PROCESSING METHOD AND DEVICE FOR IMPROVING VISIBILITY OF AN IMAGE

(75) Inventors: Yong-Seok Choi, Yongin (KR); Geun-Young Jeong, Yongin (KR); Byung-Ki Chun, Yongin (KR); Jong-Woong Park, Yongin (KR); Joo-Hyung Lee, Yongin (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 255 days.

(21) Appl. No.: 13/030,099

(22) Filed: Feb. 17, 2011

(65) Prior Publication Data

US 2012/0098848 A1 Apr. 26, 2012

(30) Foreign Application Priority Data

Oct. 22, 2010 (KR) ..... 10-2010-0103455

(51) Int. Cl.
*G09G 5/02* (2006.01)

(52) U.S. Cl.
USPC ..... 345/589

(58) Field of Classification Search
USPC ..... 345/589
See application file for complete search history.

(56) References Cited

U.S. PATENT DOCUMENTS

| | | | | |
|---|---|---|---|---|
| 2008/0272999 | A1* | 11/2008 | Kurokawa et al. | 345/89 |
| 2010/0309107 | A1* | 12/2010 | Muroi et al. | 345/88 |
| 2011/0249086 | A1* | 10/2011 | Guo et al. | 348/14.12 |

FOREIGN PATENT DOCUMENTS

| | | | |
|---|---|---|---|
| KR | 10-0667086 | B1 | 1/2007 |
| KR | 10-0732813 | B1 | 6/2007 |
| KR | 10-0745982 | B1 | 7/2007 |
| KR | 10-0827239 | B1 | 4/2008 |
| KR | 10-0844774 | B1 | 7/2008 |
| KR | 10-2009-0076033 | A | 7/2009 |

OTHER PUBLICATIONS

Chang, Naehyuck, Inseok Choi, and Hojun Shim. "DLS: dynamic backlight luminance scaling of liquid crystal display." Very Large Scale Integration (VLSI) Systems, IEEE Transactions on 12.8 (2004): 837-846.*

Cheng, Liang, Shivajit Mohapatra, M. E. Zarki, Nikil Dutt, and Nalini Venkatasubramanian. "A backlight optimization scheme for video playback on mobile devices." In Proc. CCNC, vol. 2, pp. 833-837. 2006.*

Pasricha, Sudeep, et al. "Dynamic backlight adaptation for low-power handheld devices." Design & Test of Computers, IEEE 21.5 (2004): 398-405.*

* cited by examiner

*Primary Examiner* — Aaron M Richer
*Assistant Examiner* — Vu Nguyen
(74) *Attorney, Agent, or Firm* — Knobbe Martens Olson & Bear LLP

(57) ABSTRACT

An image processing device, an image processing method, and a flat panel display are disclosed. According to some aspects, the image processing device may include: an image determining unit for determining a kind of an input image as one of a moving picture, a photograph image, and a user interface image. A legibility improving unit may be configured to generate a legibility improved image by extracting specific pixels from input image according to the kind of the input image and by modifying gray scale values of the extracted specific pixels. According to some aspects, an illuminance sensor for sensing external illuminance, and a brightness improving unit for correcting a gamma curve according to the illuminance sensor is provided. Brightness may be controlled to increase outdoor visibility of an image according to the external illuminance.

15 Claims, 4 Drawing Sheets

IMAGE PROCESSING METHOD AND DEVICE FOR IMPROVING VISIBILITY OF AN IMAGE

CROSS-REFERENCE TO RELATED APPLICATIONS

This application claims priority to and the benefit of Korean Patent Application No. 10-2010-0103455, filed on Oct. 22, 2010, in the Korean Intellectual Property Office, the entire content of which is incorporated herein by reference.

BACKGROUND

1. Field

The technological field relates to an image processing device, an image processing method, and a flat panel display device. More particularly, the technological field relates to an image processing device in which outdoor visibility of an image is increased by controlling brightness according to a kind of an image, external illuminance, an image processing method performed therein, and/or a flat panel display apparatus having the same.

2. Description of the Related Technology

Flat panel display technologies may include liquid crystal display devices (LCD), plasma display panels (PDP), field emission display devices (FED), electrophoretic display devices (EPD), and organic light emitting display devices (OLED) Recently, a next generation organic light emitting display has been developed. The next generation organic light emitting display may include various self light emitting flat panel displays capable of reducing weight and volume relative to a cathode ray tube.

These flat panel displays may be used as a display screen of a TV, a personal mobile terminal such as a digital camera or the like, a camcorder, a mobile phone, a personal digital assistant (PDA), and/or a laptop computer.

In general, a display screen of the personal mobile terminal provides a function such that a user may see his/her desired content any time and anywhere and is exposed to various ambient effects due to 'portability' and 'mobility'.

However, an image displayed on the display screen of a personal mobile terminal is seen differently according to ambient effects such as illuminance. Particularly, when ambient illuminance is much brighter than brightness of the display screen, for example on a sunny day, visibility of an image displayed on the display screen may be rapidly lowered.

This visibility lowering may serve as a factor of attenuating advantages to the mobility of a person mobile terminal.

Therefore, a need exists to maintain visibility of an image displayed on a display screen even when ambient effects vary. There also exists a need to prevent visibility of the image from being lowered due to the ambient effects of high illuminance.

SUMMARY OF CERTAIN INVENTIVE ASPECTS

One aspect includes, an image processing device, an image processing method, and a flat panel display device for increasing outdoor visibility of an image by controlling brightness according to a kind of an image and external illuminance.

In another aspect, the image processing device includes an image determining unit configured to determine a kind of an input image as one of a moving picture, a photograph image, and a user interface image. The image processing device may further include a legibility improving unit configured to generate a legibility improved image by extracting specific pixels from pixels included in the input image according to the kind of the input image that is determined by the image determining unit, and wherein the legibility improving unit is further configured to modify gray scale values of the extracted specific pixels. The image processing device may further include an illuminance sensor for sensing external illuminance, and a brightness improving unit for correcting a gamma curve according to the external illuminance sensed by the illuminance sensor.

In another aspect, the image processing method includes determining a kind of an input image as one of a moving picture, a photograph image, and a user interface image, extracting specific pixels from pixels included in the input image according to the kind of the input image that is determined, and generating a legibility improved image by modifying gray scale values of the extracted specific pixels. The method further includes correcting a gamma curve according to external illuminance sensed by an illuminance sensor, and displaying the legibility improved image according to the corrected gamma curve.

BRIEF DESCRIPTION OF THE DRAWINGS

The accompanying drawings, together with the specification, illustrate exemplary embodiments according to various aspects, and, together with the description, serve to explain exemplary embodiments.

DETAILED DESCRIPTION OF CERTAIN INVENTIVE EMBODIMENTS

Figure 1:
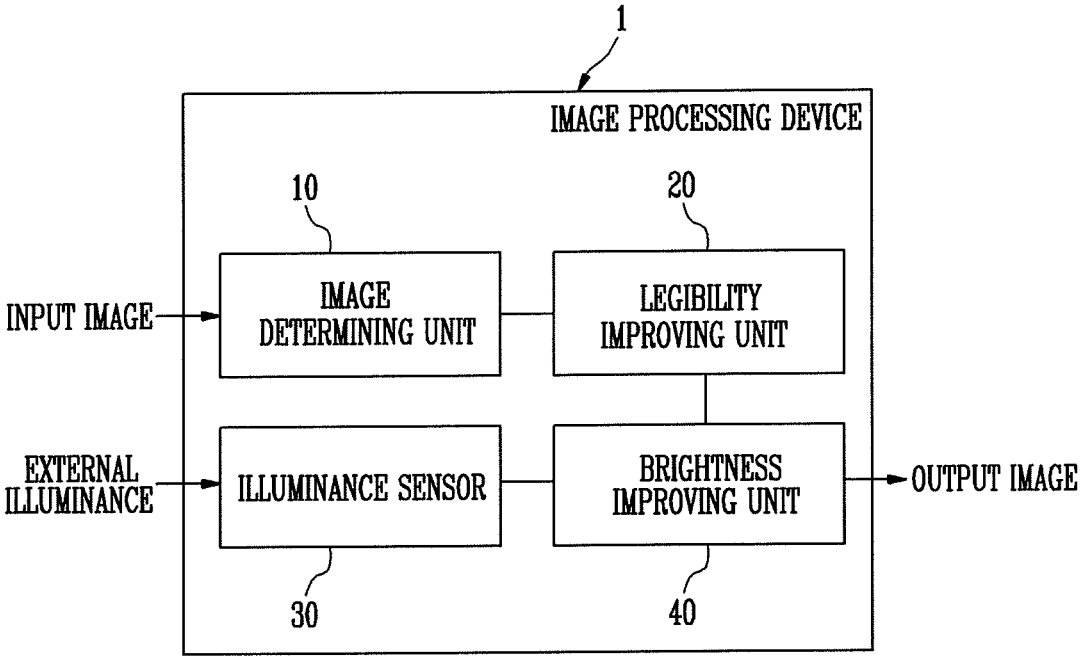
FIG. 1 is a view illustrating an image processing device according to some embodiments.

Hereinafter, certain exemplary embodiments will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

Hereinafter, embodiments of will be described in detail with reference to the accompanying drawings.

FIG. 1 is a view illustrating an image processing device according to some embodiments. An image processing device 1 according to some embodiments includes an image determining unit 10, a legibility improving unit 20, an illuminance sensor 30, and a brightness improving unit 40.

An input image may be configured as information or image data which a user wants to see and which is classified into a moving picture, a photograph image, and/or a user interface (UI).

The image determining unit 10 determines a kind of the input image input into the image processing device 1. That is, the image determining unit 10 may determine whether the input image belongs to one of of a moving picture, a photograph image, and a user interface (UI) image.

Particularly, according to some embodiments, the image determining unit 10 determines whether the input image is a moving picture or a still image first, and then whether the input image is a photograph image or a user interface (UI)

image when the input image is determined as a still image. In addition, the image determining unit 10 notifies the determined kind of the input image to the legibility improving unit 20.

Since a moving picture is an image whose image information is changed every frame or at a specific frame, the image determining unit 10 compares previous frame data with current frame data of the input image. The image determining unit 10 determines the input image as a moving picture when the image information of the respective frame information is not identical and determines a still image when the image information of respective frame data is identical.

The image information to be compared with the respective frame data may be average brightness of the respective frame data, or histogram distribution indicating frequency of brightness of the respective frame data. That is, a moving picture is determined when average brightness of a previous frame data is not identical to current frame data and when histogram distribution of the previous frame data is not identical to histogram distribution of the current frame data. When the image information is identical, a still image is determined.

When the input image is determined as a still image, the image determining unit 10 determines whether the input image is a photograph image or a user interface (UI) image. Since the previous frame is identical to the current frame when the input image is determined as a still image, a different determining method is required in order to distinguish a photograph image from a UI image.

To this end, an image processing unit 10 compares the number of pixels having a gray scale difference with surrounding pixels higher than a predetermined value, among pixels which are included in the input image that is determined as a still image, with the total number of pixels in the input image. The image determining unit 10 determines the input image as a UI image when the compared result is higher than a predetermined ratio and as a photograph image when the compared result is lower than the predetermined ratio.

The surrounding pixel may include pixels directly adjacent to or near a specific pixel and pixels within a predetermined range from the specific pixel.

For example, the image determining unit 10 may be set to count the number of pixels having a difference of 50 more gray scales from the number of surrounding pixels in 255 gray scales. The image determining unit 10 may then determine the input image as a UI image when the counted number of pixels is higher than 10% of the total number of pixels. On the other hand, when the number of pixels having a difference of 50 more gray scales from surrounding pixels is less than 10% of the total number of pixels, the input image may be determined as a photograph image. One of skill in the art will recognize that the gray scale difference values and predetermined ratio of pixels is not limited to the example provided above, but can be alternatively set to any number of values.

The legibility improving unit 20 may generate a legibility improved image by extracting specific pixels of the pixels included in the input image according to a kind of the input image and by modifying a gray scale value of the extracted specific pixels.

According some embodiments, when an input image is determined as a moving picture or a photograph image by the image determining unit 10, the legibility improving unit 20 extracts specific pixels having gray scale values lower than a predetermined gray scale value from the pixels included in the input image and increases the gray scale values of the extracted specific pixels.

For example, if it is set to extract pixels having gray scales less than a 60 gray scale value at 255 gray scales, the legibility improving unit 20 analyzes gray scales of respective pixels and extracts pixels having gray scale values ranging from 0 to 60.

In addition, an increase of gray scale values may be achieved by multiplying the gray scale values of the extracted specific pixels with a scaling factor or adding the scaling factor to the gray scale values of the extracted specific pixels. Therefore, the visibility can be reinforced by increasing a gray scale value of a dark portion of a moving picture and a photograph image.

The legibility improving unit 20 may extract specific pixels having gray scale values lower than a predetermined gray scale from pixels included in the input image when the input image is determined as a moving picture or a photograph image, but may maintain the gray scale values without modification when the number of the extracted specific pixels is smaller than a predetermined ratio in comparison to the total number of pixels. For example, the legibility improving unit 20 may maintain the gray scale values of the extracted specific pixels when the number of the specific pixels is less than 10% of the total number of the pixels.

This is to display the input image as it is without modifying the gray scale values because, if the portion of the input image is determined as a dark portion which encompasses a relatively small area in comparison to overall resolution, the dark portion may not be considered an image but may instead be considered a shaded portion.

When the input image is determined as a user interface (UI) image, the legibility improving unit 20 may select a gray scale value of the highest frequency from the input image as a background screen value, increase a gray scale value of a pixel higher than that of the background screen value, and decrease a gray scale value of a pixel lower than that of the background screen value.

The user interface (UI) image may include a background screen and text and an image portion that are displayed in the background screen. In this case, since the background screen generally occupies the widest region with a single gray scale value in the user interface (UI) image, a gray scale value of the highest frequency in the input image is the same gray scale value (background screen value) of the background screen.

Therefore, legibility of text and an image can be increased by increasing a gray scale value of a pixel higher than that of the background screen value and lowering a gray scale value of a pixel lower than that of the background screen value.

The increase and reduction of the gray scale value may be made by the four fundamental mathematical operations of the gray scale values of pixels with a scaling factor.

The illuminance sensor 30 may sense external illuminance and notify the sensed external illuminance to the brightness improving unit 40.

Figure 2:
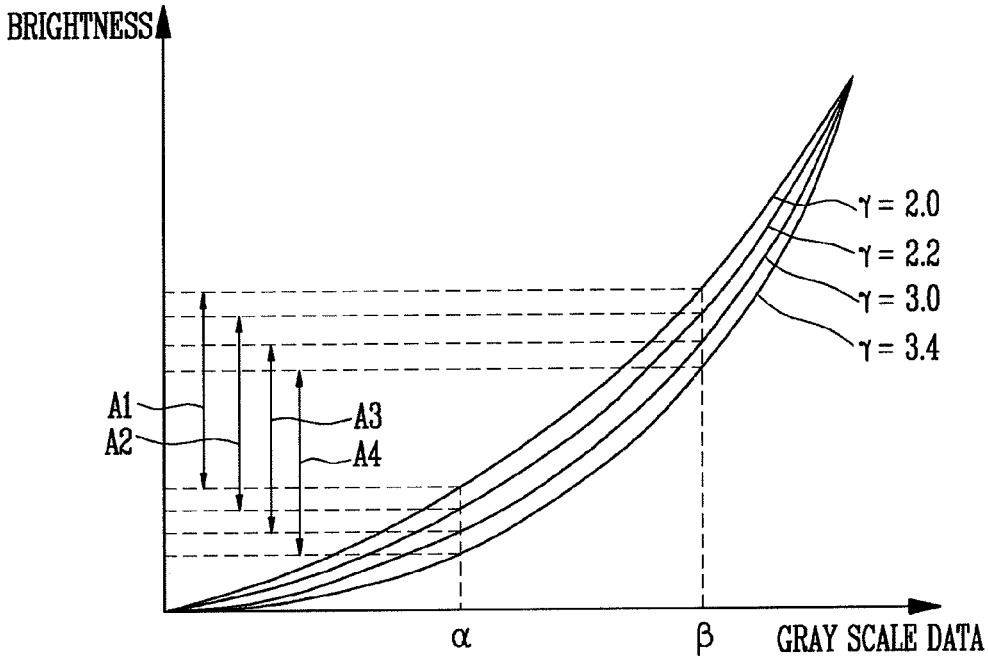
FIGS. 2 and 3 are graphs schematically illustrating examples of correcting gamma curves according to some embodiments.
Figure 3:
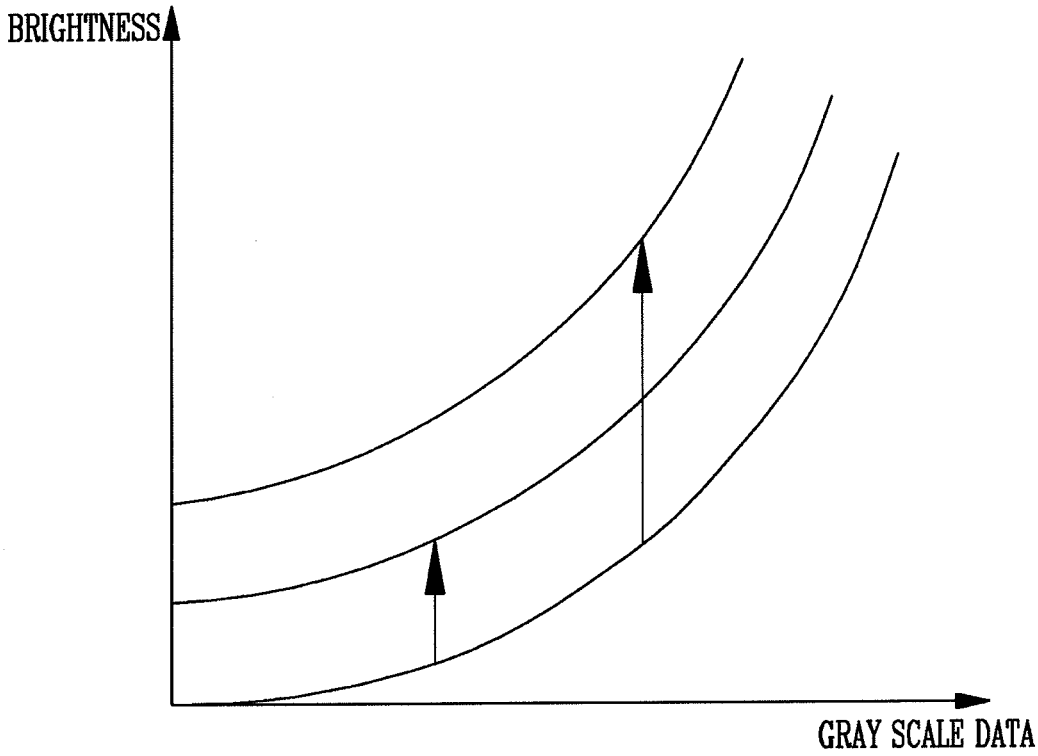

FIGS. 2 and 3 are graphs schematically illustrating examples of correcting gamma curves according to some embodiments. First, a gamma curve will be briefly described as follows.

An output value with respect to an input value in the display device, in general, is not expressed in a linear fashion. That is, the output value with respect of the input value is not represented by a first order function, but is expressed in a nonlinear fashion by a high order function of a curve as illustrated in FIGS. 2 and 3. In FIGS. 2 and 3, the X-axis represents gray scale data of an image signal that is input to a display device and the Y-axis represents an output brightness that is displayed on the display device by the gray scale data. If an output value with respect to an input value in the display device is linear, the graphs would therefore be linear. However, since an output value with respect to an input value is not linear in general display devices, the graphs are nonlinear.

The brightness improving unit 40 corrects a gamma curve according to the external illuminance sensed by the illuminance sensor 30.

Referring to FIG. 2, the brightness improving unit 40 corrects the gamma curve such that a gamma value $\gamma$ becomes smaller as the external illuminance sensed by the illuminance sensor 30 is high. Since FIG. 2 shows gamma curves having 2.0, 2.2, 3.0, and 3.4 of gamma values, it is understood that brightness output based on the respective gamma curves range over any number of different values such as A1, A2, A3, and A4 even when gray scale values of a same section from $\alpha$ to $\beta$. Particularly, in this case, when gray scale values of the same section are input, output brightness is lowered as the gamma values are increased.

This, on the contrary, means that output brightness is increased as the gamma values are lowered when gray scale values of the same section are input. Therefore, when the brightness improving unit 40 corrects the gamma curves such that the gamma values are lowered as ambient effects produce abright effect, an image having a high brightness is displayed under the same conditions so that increased visibility of an image can be provided to a user. In addition, on the contrary, when ambient effects are dark, the brightness improving unit 40 corrects the gamma curves such that the gamma values are increased so that an image of excessive brightness is not produced, but rather an image of suitable brightness corresponding to the ambient brightness is displayed.

For the modification of gamma values as described above, the brightness improving unit 40 according to some embodiments further includes a memory unit (not shown) to which a lookup table is stored and corrects the gamma curves by referring to the lookup table.

In the lookup table, gamma values corrected according to a predetermined external illuminance are recorded. For example, it may be set such that a corrected gamma value is assigned to 1.0 when external illuminance is 10,000 lux to 15,000 lux, that a corrected gamma value is increased when external illuminance is less than 10,000 lux, and that a corrected gamma value is decreased when external illuminance is higher than 10,000 lux.

The brightness improving unit 40 may extract a corrected gamma value corresponding to external illuminance sensed by the illuminance sensor 30 from the lookup table and correct the gamma curve using the extracted corrected gamma value instead of an existing gamma value.

The gamma curves may be corrected while maximum and minimum of the output brightness are fixed in the embodiment illustrated in FIG. 2, but maximum and minimum of the output brightness vary according to movement of the gamma curves according to other embodiments as illustrated in FIG. 3.

When the gamma curve moves parallel to a positive direction of the Y-axis as illustrated in FIG. 3, output brightness with respect to input gray scale is increased on the whole. Therefore, when the gamma curves are moved in the positive direction of Y-axis as external illuminance is high, an image of high brightness is displayed under the same conditions so that an image having improved visibility can be provided to a user. When ambient effects are dark, the gamma curves are moved in a negative direction of Y-axis, and an image of excessive brightness is not produced but an image of suitable brightness to which ambient illuminance is applied is displayed.

The correction of the gamma curves illustrated in FIGS. 2 and 3 may be performed individually or simultaneously.

The image processing device 1 may be included in a flat panel display device. In this case, the flat panel display device displays an image of improved legibility that is generated by the legibility improving unit 20 according to the gamma curves corrected by the brightness improving unit 40 of the image processing device 1.

The flat panel display device may be a liquid crystal display (LCD) device, a field emitting display (FED) device, a plasma display panel (PDP), and an organic light emitting display (OLED) device.

Figure 4:
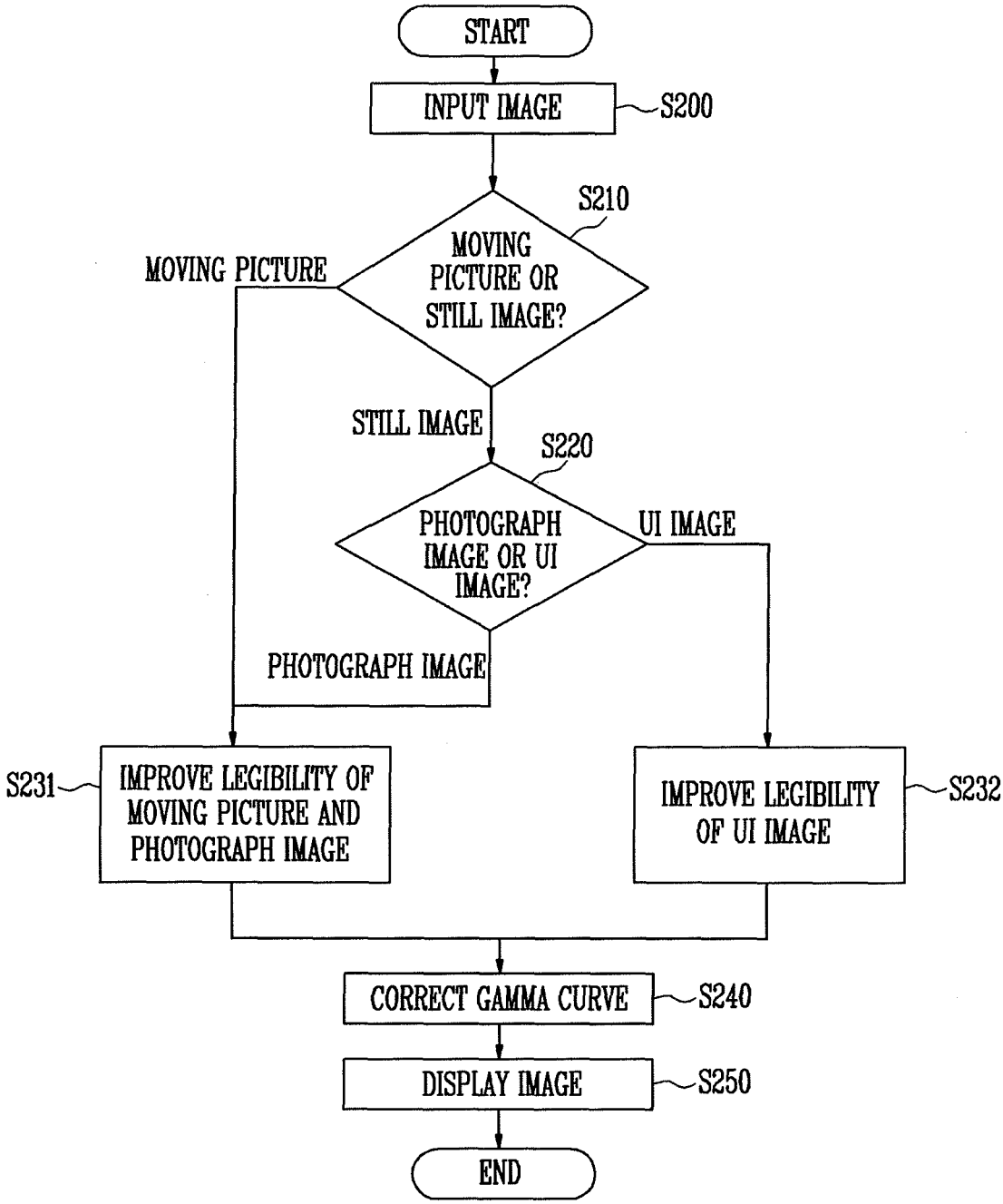
FIG. 4 is a flowchart illustrating an image processing method according to some embodiments.

FIG. 4 is a flowchart illustrating an image processing method according to some embodiments. The image processing method includes (a) determining a kind of an input image, (b) improving legibility, (c) correcting a gamma curve, and (d) displaying the image.

First, in the step of (a) determining a kind of an input image will be described. When the input image is input to an input processing device (S200), whether the input image is a moving picture or a still image is determined as represented by decision block (S210). When the input image is determined as a still image, whether the input image is a photograph image or a user interface (UI) image is determined as represented by decision block (S220).

When the kind of the input image is determined, step (b) of improving legibility is performed. In step (b) of improving legibility, a legibility improved image in which gray scale values of specific pixels included in the input image are generated. The legibility improvement is performed separately when the input image is determined as a moving picture and a photograph image as represented by block (S231) and when the input image is determined as a user interface (UI) image as represented by block (S232).

When step (b) of improving legibility is completed, step (c) of correcting a gamma curve may be performed (S240). In step (c) of correcting a gamma curve, the gamma curve is corrected according to external illuminance sensed by an illuminance sensor 30 to correct the gamma curve such that output brightness with respect to a same gray scale is increased as the external illuminance is increased.

When step (c) of correcting a gamma curve is completed, step (d) of displaying the legibility improved image that is generated in step (b) of improving legibility according to the gamma curve corrected in step (c) of correcting a gamma curve as represented by block (S250). While the method steps (a)-(d) have been described in a particular order, one will recognize that any combination of steps may be performed in different orders without departing from the scope of the invention.

As described above, according to some aspects, an image processing device including: an image determining unit for determining a kind of an input image as one of a moving picture, a photograph image, and a user interface image is provided. The image processing device may include a legibility improving unit for generating a legibility improved image by extracting specific pixels from pixels included in the input image according to the kind of the input image that is determined by the image determining unit and by modifying gray scale values of the extracted specific pixels, and an illuminance sensor for sensing external illuminance, and a brightness improving unit for correcting a gamma curve according to the external illuminance sensed by the illuminance sensor.

According to some aspects, the image determining unit may be configured to determine whether the input image is a moving picture or a still image by comparing previous frame data of the input image with current frame data of the input image. In a case when the input image is determined as a still image, the image determining unit may be configured to determine the input image as a user interface image when a number of pixels of the pixels included in the input image having a higher gray scale difference with surrounding pixels higher than a predetermined gray scale difference is higher than a predetermined ratio of the number of pixels with the higher gray scale difference and a total number of pixels The image determining unit may determine the input image as a photograph image when the number of pixels of the pixels included in the input image having a gray scale difference with surrounding pixels higher than predetermined gray scale difference is lower than the predetermined ratio of a number of pixels with higher gray scale difference and a total number of pixels.

A legibility improving unit may extracts specific pixels having gray scale values lower than a predetermined value from the pixels included in the input image and increase the gray scale values of the extracted specific pixels when the input image is determined as a moving picture or a photograph image. The legibility improving unit may select a gray scale value having the highest frequency in the input image as a background screen value, increase a gray scale value of a pixel higher than the selected background screen value, and decrease a gray scale value of a pixel lower than the selected background screen value, when the input image is determined as a user interface image.

The legibility improving unit may extract specific pixels having gray scale values lower than a predetermined value from the pixels includes in the input image when the input image is determined as a moving picture or a photograph image, and maintain the gray scale values of the extracted specific pixels when the number of the extracted specific pixels is less than a predetermined ratio of the total number of pixels.

In addition, a brightness improving unit may be provided for correcting the gamma curve such that output brightness with respect to a same gray scale value is increased as the external illuminance sensed by the illuminance sensor is increased.

The brightness improving unit may further include a memory unit to which a lookup table in which corrected gamma values according to external illuminance is stored, extracts a corrected gamma value corresponding to the illuminance sensed by the illuminance sensor from the lookup table and corrects the gamma curve.

According to some aspects, there is provided an image processing method including: determining a kind of an input image as one of a moving picture, a photograph image, and a user interface image, extracting specific pixels from pixels included in the input image according to the kind of the input image that is determined, and generating a legibility improved image by modifying gray scale values of the extracted specific pixels. The method may further include correcting a gamma curve according to external illuminance sensed by an illuminance sensor, and displaying the legibility improved image according to the corrected gamma curve.

The method may further include determining whether the input image is a moving picture or a still image by comparing previous frame data with current frame data of the input image, and determining, in a case when the input image is determined as a still image, the still image as a user interface image when the number of pixels, of the pixels that are included in the input image, having predetermined gray scale difference higher from surrounding pixels is higher than a predetermined ratio of the pixels included in the input image. The method may determine that the still image is a photograph image when the number of pixels having the predetermined gray scale difference higher from the surrounding pixels is lower than a predetermined ratio of the pixels included in the input image.

Furthermore, the method may include extracting specific pixels having gray scale values lower than a predetermined value from the pixels included in the input image, and the gray scale values of the extracted specific pixels may be increased when the input image is determined as a moving picture or a photograph image. When the input image is determined as a user interface image, a gray scale value of the highest frequency in the input image may be selected as a background screen value, a gray scale value of a pixel higher than the selected background screen value is increased, and a gray scale value of a pixel lower than the selected background screen value is decreased.

When the input image is determined as a moving picture or a photograph image, specific pixels having gray scale values lower than the predetermined value may be extracted from the pixels included in the input image and the gray scale valued of extracted specific pixels are maintained when the number of the extracted specific pixels is smaller than a predetermined ratio of the total number of pixels.

Furthermore, a gamma curve is corrected such that output brightness with respect to a same gray scale value is increased as the external illuminance sensed by the illuminance sensor is increased. A gamma curve may be modified by extracting a corrected gamma value corresponding to the external illuminance sensed by the illuminance sensor from a lookup table.

In order to achieve the foregoing and/or other aspects of the present invention, according some embodiments, there is provided a flat panel display device which includes the image processing device and displays the legibility improved image according to the gamma curve corrected by the brightness improving unit.

According to some aspects, an image processing device, an image processing method, and a flat panel display device for increasing outdoor visibility of an image by controlling brightness accord to a kind of an image and external illumination. The present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An image processing device, comprising:

an image determining unit configured to determine a kind of an input image as one of a moving picture, a photograph image, and a user interface image by comparing previous frame data of the input image with current frame data of the input image, and in a case when the input image is determined as a still image, the image determining unit is further configured to:

determine that the input image is a user interface image when the number of pixels having gray scale difference between the pixels included in the input image and surrounding pixels higher than predetermined gray scale difference is higher than a predetermined ratio of the total number of pixels; and determine the input image as a photograph image when the number of pixels having gray scale difference between the pixels included in the input image and the surrounding pixels higher than predetermined gray scale difference is lower than the predetermined ratio of the total number of pixels;

a legibility improving unit configured to generate a legibility improved image by extracting specific pixels from pixels included in the input image according to the kind of the input image that is determined by the image determining unit, and wherein the legibility improving unit is further configured to modify gray scale values of the extracted specific pixels;

an illuminance sensor for sensing external illuminance; and a brightness improving unit for correcting a gamma curve according to the external illuminance sensed by the illuminance sensor.

2. The image processing device as claimed in claim 1, wherein the legibility improving unit is further configured to:

increase the gray scale values of the extracted specific pixels when the input image is determined as a moving picture or a photograph image; and select a gray scale value having the highest frequency in the input image as a background screen value, increase a gray scale value of a pixel higher than the selected background screen value, and decrease a gray scale value of a pixel lower than the selected background screen value, when the input image is determined as a user interface image.

3. The image processing device as claimed in claim 2, wherein the legibility improving unit is configured to:

extract specific pixels having gray scale values lower than a predetermined value from the pixels includes in the input image when the input image is determined as a moving picture or a photograph image; and maintain the gray scale values of the extracted specific pixels when the number of the extracted specific pixels is smaller than a predetermined ratio of the total number of pixels.

4. The image processing device as claimed in claim 1, wherein the brightness improving unit is configured to correct the gamma curve such that output brightness with respect to a same gray scale value is increased as the external illuminance sensed by the illuminance sensor is increased.

5. The image processing device as claimed in claim 1, wherein the brightness improving unit further includes a memory unit which is configured to store a lookup table of corrected gamma values according to external illuminance, and wherein the brightness improving unit is configured to extract a corrected gamma value corresponding to the illuminance sensed by the illuminance sensor from the lookup table and correct the gamma curve.

6. A flat panel display device comprising the image processing device as claimed in claim 1, wherein the flat panel display device is configured to display the legibility improved image according to the gamma curve corrected by the brightness improving unit.

7. The device of claim 1, wherein the image determining unit is configured to compare each pixel of a previous frame of the input image to a corresponding pixel of a current frame of the input image.

8. The device of claim 7, wherein the image determining unit is configured to:

determine the input image to be a moving picture when each pixel of the previous frame is not identical to the corresponding pixel of the current frame; and determines the input image to be a photograph image or user interface image when each pixel of the previous frame is identical to the corresponding pixel of the current frame.

9. An image processing method comprising:

determining a kind of an input image as one of a moving picture, a photograph image, and a user interface image by comparing previous frame data with current frame data of the input image;

determining, in a case when the input image is determined as a still image whether the still image is a user interface image or a photograph image, wherein the still image is determined as a user interface image when the number of pixels that are included in the input image having predetermined gray scale difference higher from surrounding pixels is higher than a predetermined ratio of the pixels included in the input image, and wherein the still image is determined as a photograph image when the number of pixels having the predetermined gray scale difference higher than the surrounding pixels is lower than a predetermined ratio of the pixels included in the input image;

extracting specific pixels having gray scale values lower than a predetermined value from pixels included in the input image according to the kind of the input image that is determined;

generating a legibility improved image by modifying gray scale values of the extracted specific pixels;

correcting a gamma curve according to external illuminance sensed by an illuminance sensor; and displaying the legibility improved image according to the corrected gamma curve.

10. The image processing method as claimed in claim 9, wherein extracting specific pixels further comprises:

increasing the gray scale values of the extracted specific pixels when the input image is determined as a moving picture or a photograph image; and selecting a gray scale value of the highest frequency in the input image as a background screen value, a gray scale value of a pixel higher than the selected background screen value is increased, and a gray scale value of a pixel lower than the selected background screen value is decreased when the input image is determined as a user interface image.

11. The image processing method as claimed in claim 10, wherein, when the input image is determined as a moving picture or a photograph image, specific pixels having gray scale values lower than the predetermined value are extracted from the pixels included in the input image and a gray scale value of the extracted specific pixels is maintained when the number of the extracted specific pixels is smaller than a predetermined ratio of the total number of pixels.

12. The image processing method as claimed in claim 9, wherein the gamma curve is corrected such that output brightness with respect to a same gray scale value is increased as the external illuminance sensed by the illuminance sensor is increased.

13. The image processing method as claimed in claim 9, wherein the gamma curve is modified by extracting a corrected gamma value corresponding to the external illuminance sensed by the illuminance sensor from a lookup table.

14. The method of claim 9, wherein determining a kind of input image as one of a moving picture, a photograph image, and a user interface image comprises comparing each pixel of a previous frame of the input image to a corresponding pixel of a current frame of the input image.

15. The method of claim 14, wherein the input image is determined to be a moving picture when each pixel of the previous frame is not identical to the corresponding pixel of the current frame, and the input image is determined to be photograph image or user interface image when each pixel of the previous frame is identical to the corresponding pixel of the current frame.

* * * * *